United States Patent [19]

Rodler, Jr.

[11] 4,073,257

[45] Feb. 14, 1978

[54] MARINE PROPULSION SYSTEM

[75] Inventor: Waldo E. Rodler, Jr., San Jose, Calif.

[73] Assignee: Turbo Engineering Corporation, Signal Hill, Calif.

[21] Appl. No.: 708,500

[22] Filed: July 26, 1976

[51] Int. Cl.[2] ..... B63H 11/00

[52] U.S. Cl. ..... 115/12 R; 60/221; 60/230; 239/265.43

[58] Field of Search ..... 115/11, 12 R, 41 R, 115/14, 16; 239/265.43; 60/221, 222, 242

[56] References Cited

U.S. PATENT DOCUMENTS

| | | | |
|---|---|---|---|
| 3,030,909 | 4/1962 | Barnes et al. | 115/12 R |
| 3,192,715 | 7/1965 | Engel et al. | 115/14 X |
| 3,214,903 | 11/1965 | Cochran | 115/14 X |
| 3,336,752 | 8/1967 | Smith | 115/12 R |
| 3,495,407 | 2/1970 | Davis | 115/16 X |
| 3,809,005 | 5/1974 | Rodler | 115/12 R |

FOREIGN PATENT DOCUMENTS

| | | | |
|---|---|---|---|
| 1,492,084 | 7/1967 | France | 115/14 |

*Primary Examiner*—Trygve M. Blix
*Assistant Examiner*—Edward M. Wacyra
*Attorney, Agent, or Firm*—Jack M. Wiseman

[57] ABSTRACT

A jet propulsion system for boats in which the thrust force center line is below the boat reaction center line to urge the propulsion system thrust line to tilt downwardly. The tilting of the propulsion system thrust line downwardly lifts the stern of the hull to create a suitable vertical vector. As a consequence thereof, the boat is urged into a planing position for the reduction of drag on the boat in the lower speed range. At the higher speeds, dynamic water pressure reacts on the intake to urge the tilting of the thrust force center line upwardly toward a horizontal position to reduce the depth of the bow of the boat submerged in water for reducing the drag on the boat. A tension spring controls the angle of the tilting of the thrust force center line to attain the changeover at a selected speed for optimum operation.

14 Claims, 7 Drawing Figures

Fig. 7
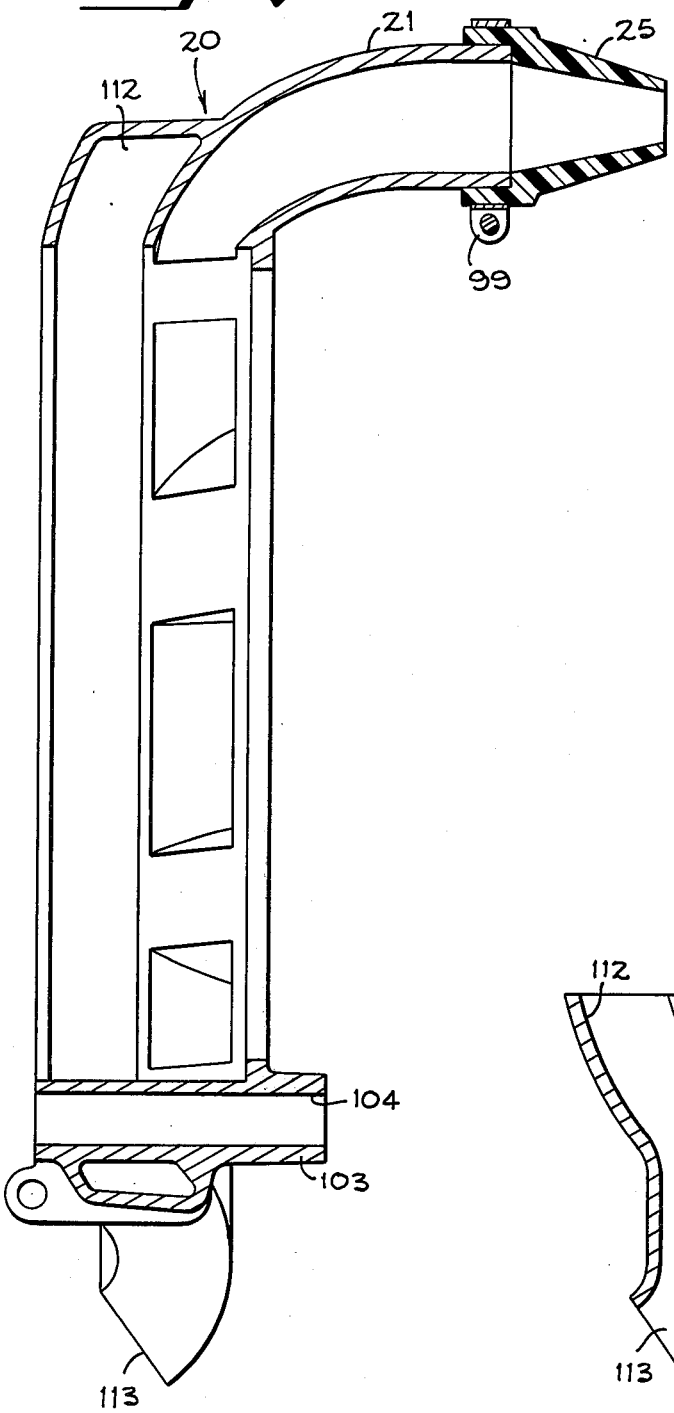
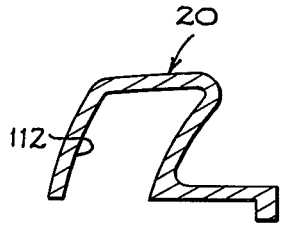
Fig. 5
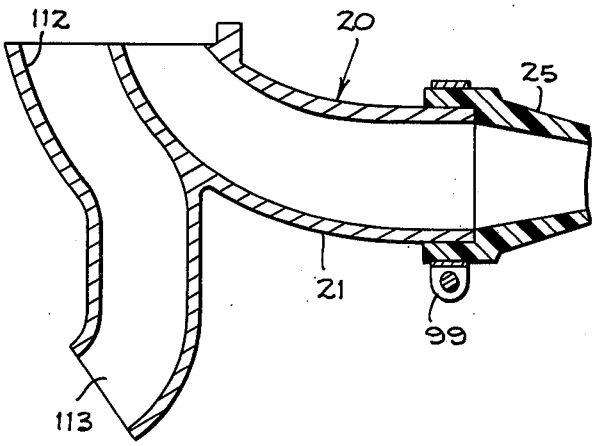
Fig. 6

MARINE PROPULSION SYSTEM

BACKGROUND OF THE INVENTION

The present invention relates in general to propulsion systems, and more particularly to a propulsion system for a water vehicle.

Water jet propulsion systems have been disclosed in the following U.S. patents:

U.S. Pat. No. 3,809,005, issued on May 7, 1974, to the applicant of the present application for Propulsion System;

U.S. Pat. No. 3,336,752, issued on Aug. 22, 1967, to M. S. Smith for Jet Boat Propulsion Unit;

U.S. Pat. No. 3,283,737, issued on Nov. 8, 1966, to C. A. Gongwer for Jet Propulsion Device For Water Vehicles;

U.S. Pat. No. 3,212,258, issued on Oct. 19, 1965, to C. A. Gongwer for Water-Jet Propulsion Device For Boats.

Another patent of interest is the U.S. patent to George F. Wislicenus, U.S. Pat. No. 3,575,127, issued on Apr. 13, 1971, for Vehicle Propulsion Systems.

It has been heretofore known that the adjustment of the thrust line angle can provide improved performance in propulsion systems for boats and particularly the performance of boats employing planing type hulls. Outboard engines have been provided with a series of holes and movable pins to provide for the adjustment of the thrust line angle. The inboard/outdrive propulsion systems have employed complex electro-hydraulic systems and electro-mechanical systems to adjust the thrust line angle for improved performance. Additionally, the inboard/outdrive propulsion systems have employed a series of holes and movable pins and hydraulic power trim systems for adjusting the thrust line angle for improved performance. Tilt cylinders have also been employed in the past. In jet propulsion systems, there was either no adjustment, a manual adjustment or a power adjustment. As part of a jet propulsion system, a complex electro-hydraulic and electro-mechanical system were employed for adjusting the thrust angle for improved performance.

It has been known that the efficiency of a jet propulsion system is related to the size of the nozzle. Large nozzles permit a maximum flow rate of water which results in maximized propulsive efficiency. It has also been found that a reduced nozzle size minimizes the tendency to cavitate which can cause a gross loss of performance in the lower speed range, i.e. 8–20 miles per hour. A conventional nozzle is generally arranged to minimize the size of the nozzle and the flow rate of water to prevent cavitation. The failure of a nozzle to maximize the flow rate of water and to minimize the cavitation resulted in greater fuel consumption, greter engine noise and reduced engine life.

In the patent to Rodler, Jr. U.S. Pat. No. 3,809,005, the shield or deflector for reversing the direction of thrust had an annular configuration and a series of arc-shaped forward jet ports which produced essentially an annular jet. The annular jets were not totally effective in clearing foreign matter entrained in the water about the intake duct. The deflector was not fully effective in controlling reverse water flow.

SUMMARY OF THE INVENTION

A jet propulsion system for a water vehicle in which a spring controls the angle of tilting of the thrust force center line to attain the changeover at a selected speed for optimum operation.

A jet propulsion system for a water vehicle in which the thrust force center line is below the boat reaction center line to urge the tilting of the thurst force center line downwardly. At higher speeds, the dynamic water pressure urges the tilting of the thrust force center line upwardly. A thrust center line of the jet propulsion system is disposed below a reaction center line for the jet propulsion system to urge the propulsive thrust angle upwardly to attain a changeover between the upward tilt angle and downward tilt angle for optimum operation.

A jet propulsion system for a water vehicle in which a resilient discharge nozzle discharges water to create a jet reaction for the propelling of the water vehicle. At increased power of the water vehicle, the resilient nozzle expands to increase the flow rate of water through the discharge orifice thereof. At reduced power of the water vehicle, the resilient nozzle contracts to increase the velocity of the water discharged through the orifice thereof.

A jet propulsion system for a water vehicle in which a reverse passage of a forward and reverse channel member is shaped to exercise greater control over the flow of reverse water flow.

A jet propulsion system for a water vehicle in which a forward and reverse channel member has a series of circular, forward jets to provide the forward jet stream in equally spaced angular distances about a circular pattern.

A feature of the present invention is to provide a jet propulsion system for a water vehicle in which the angle of tilting of the thrust force is automatically adjusted.

Another feature of the present invention is to provide a jet propulsion system for a water vehicle in which dynamic water pressure of a moving water vehicle affords a simple, dependable and economical arrangement to control the thrust angle for improving performance and for reducing fuel consumption.

Another feature of the present invention is to provide a jet propulsion system for a water vehicle with a nozzle which reduces cavitation and increases propulsive efficiency.

Another feature of the present invention is to provide a jet propulsion system for a water vehicle in which a nozzle enlarges its discharge orifice at full power of the vehicle and reduces its discharge orifice at reduced power of the vehicle. The reduced discharge orifice of the nozzle increases the discharge velocity of the water and available thrust at reduced flow rates and increases back pressure on the pump to increase the input torque requirements for causing the engine to deliver the required horsepower at higher torques and at lower RPM.

Another feature of the present invention is to provide a jet propulsion system having a reverse passage formed in a forward and reverse channel member shaped to improve control over the reverse water flow.

Another feature of the present invention is to provide a jet propulsion system having a forward and reverse channel member with a series of circular forward jets disposed equal angular distances apart in a circular pattern for clearing foreign matter that may be entrained in the water about the input duct.

DESCRIPTION OF THE DRAWINGS

FIG. 5 is a sectional view taken along line 5—5 of FIG. 2 to illustrate the forward and reverse channel member shown in FIGS. 2 and 3.

FIG. 6 is a sectional view taken along line 6—6 of FIG. 2 to illustrate the jet propelling discharge nozzle and reverse jet port embodied in the jet propulsion system shown in FIGS. 1 and 4.

FIG. 7 is a view taken along line 7—7 of FIG. 2 partially in section to illustrate the reverse passage, reverse jet ports, and jet propelling discharge nozzle embodied in the jet propulsion system shown in FIGS. 1 and 4.

DESCRIPTION OF THE PREFERRED EMBODIMENTS

Figure 1:
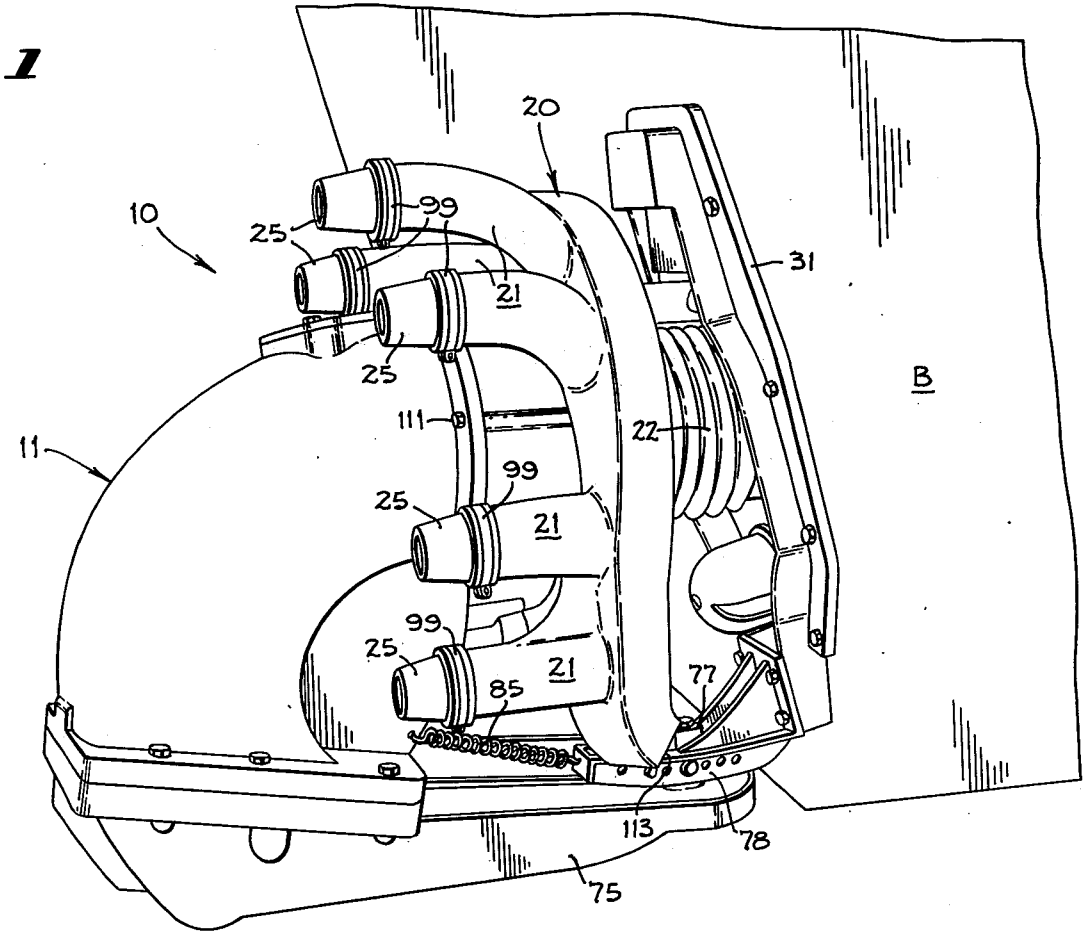
FIG. 1 is a perspective view of jet propulsion system embodying the present invention illustrated with the stern of a boat.
Figure 4:
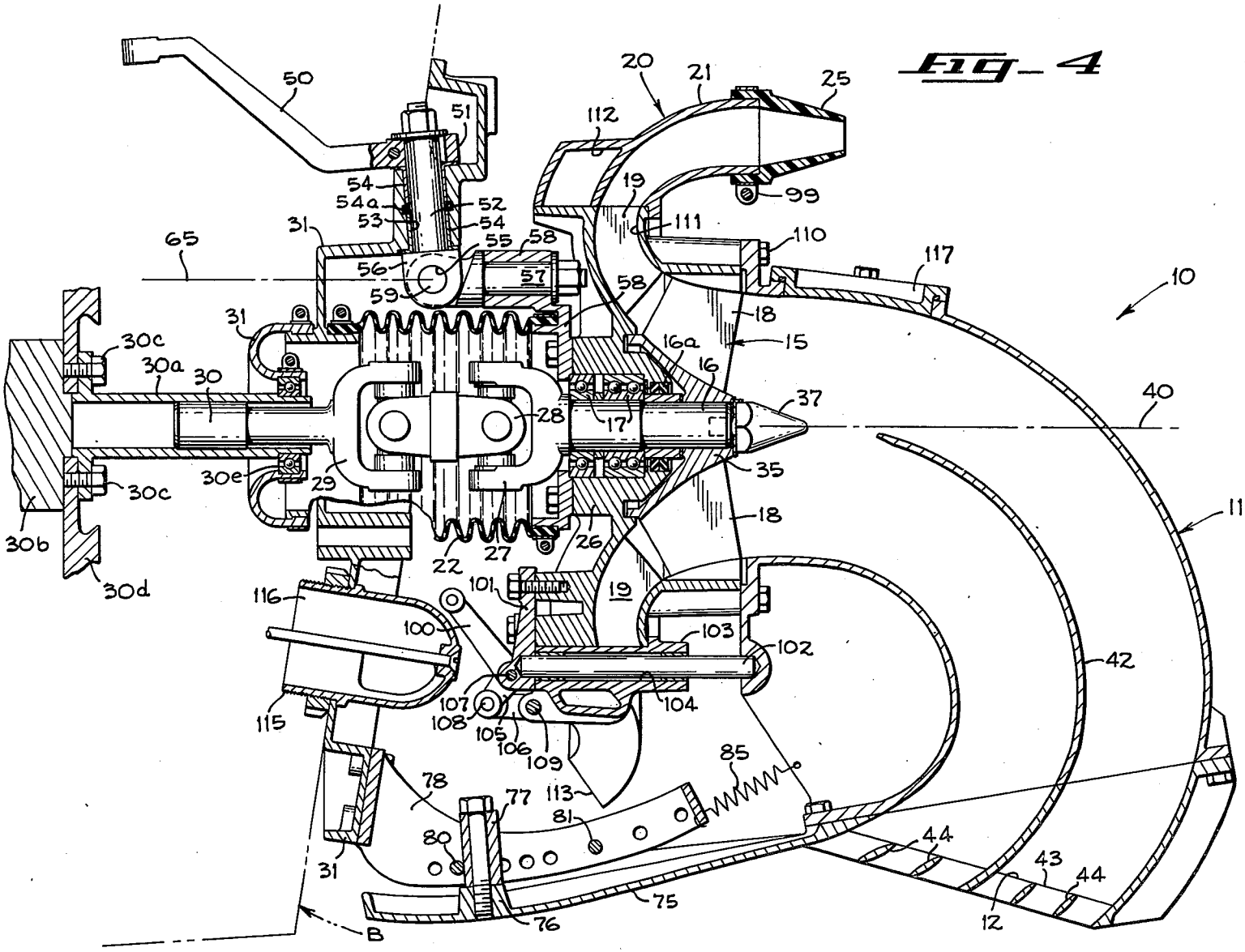
FIG. 4 is an enlarged full section side view of the jet propulsion system shown in FIG. 1.

Illustrated in FIGS. 1 and 4 is a jet propulsion system 10 for a water vehicle B, which jet propulsion system 10 embodies the present invention. The jet propulsion system 10 comprises an intake duct or horn 11 formed with an intake orifice 12 through which enters water from the body of water on which the vehicle B travels.

Disposed in the path of water advancing through the intake duct or horn 11 is an impeller 15, which comprises a shaft 16 journalled for rotation by suitable bearings 17. Fixed to the impeller shaft 16 for rotation therewith are suitable impeller blades 18. The impeller blades 18 apply dynamic and centrifugal forces to the water advancing through the intake duct 11. Stator blades 19 neutralize circumferential swirl in the water produced by the moving impeller blades 18.

Communicating with the intake duct 11 is a forward and reverse channel member 20 for receiving the water accelerating through the intake duct 11 under the action of the impeller 15 for discharge through forward jet ports of discharge nozzles 25. The nozzles 25 project from the forward and reverse channel member 20 through suitable conduits 21, respectively, integrally formed with the channel member 20. The water discharged through the forward jet ports of the nozzles 25 produces a reactive thrust or propulsive force to urge the stern of the water vehicle B in a forward direction. It is to be observed that the forward jet ports of the nozzles 25 are substantially oppositely directed with respect to the intake orifice 12.

The impeller shaft 16 and the bearings 17 therefor are mounted in a stator housing 26. An oil and water seal 17*a* surrounds the impeller shaft 16. The forward and reverse channel member 20 is supported by the stator housing 26 for fore and aft movement. Fixed to the impeller shaft 16 is a driven yoke 27 for imparting rotation thereto. Coupled to the driven yoke 27 is a universal coupling 28. Surrounding the universal coupling 28 are bellows 22 for providing a seal therefor. A drive yoke 29 is coupled to the universal coupling 28. A drive shaft 30 is fixed to the yoke 29 to impart rotation thereto. A flanged tubular shaft 30*a* is internally splined to the drive shaft 30 and is bolted directly to the engine crankshaft 30*b* by means of bolts 30*c*. Also connected by the bolts 30*c* is the engine flywheel 30*d*. Surrounding the drive shaft 30 is a mounting bracket 31, which is bolted to the lower part of the hull transom of the water vehicle B. Surrounding the tubular shaft 30*a* are sealed ball bearings 30*e*. A suitable opening is provided in the transom confronting the mounting bracket 31. Thus, there is provision for universal movement for the intake horn 11, the forward and reverse channel member 20 and the stator housing 26, and the impeller 15 about the drive assembly including the yokes 27 and 29 and the universal coupling 28.

Surrounding the impeller shaft 16 is an impeller cone extension 35. A diffuser cone 37 is disposed in alignment with the axis of the impeller shaft 16. The thrust center line of the propulsion system 10 passes through the axis of the diffuser cone 37 and the impeller shaft 16 as shown by dotted line 40 in FIG. 4. Included in the intake duct 11 is a suitable arcuate baffle 42 for reducing excess swirling and turbulence. At the lower extremity of the intake duct 11, vanes 44 are disposed at the intake orifice 12 and are supported at their midpoints by the plate 43.

A steering arm 50 has its free end connected to suitable remote cables, not shown. The distal end of the steering arm 50 is provided with a hub 51 which is keyed to a steering post 52 for imparting rotary movement thereto in response to manual movement of the steering arm 50. The post 52 is disposed within a bore 53 formed in the mounting bracket 31 and is journalled for rotation by suitable bearings 54. A suitable water seal is achieved by O-ring 54*a*. The mounting bracket 31 is fixed to the hull transom of the water vehicle B and supports the steering assembly. At the bottom of the steering post 52 is a suitable opening 55. Aligned with the opening 55 is an ear 56 of a steering knuckle 57. A suitable pin 59 interconnects the knuckle 57 with the post 52. The stator housing 26 is supported by bolts to a stator housing bracket 58 which includes a boss for the knuckle 57 for supporting the stator housing 26 from the steering assembly. Thus, the jet propulsion system is fixed to the water vehicle B by means of the bracket 31, which supports the steering assembly. The knuckle 57 of the steering assembly supports the remainder of the jet propulsion system 10 through the bracket 58 and the stator housing 26. Rotation of the steering post 52 imparts rotation to the horn 11, the forward and reverse channel member 20, the impeller 15 and the stator housing 26 through the knuckle 57 in a generally horizontal plane or about the generally upright axis of the post 52 through the knuckle 57.

According to the present invention, a desired thrust angle or tilt angle control is achieved automatically. Toward this end, the reaction center line (shown by dotted line 65 in FIG. 4) is above the thrust center line (shown by dotted line 40 in FIG. 4). Hence, the propulsive thrust at lower speeds, i.e. 12–20 MPH, tends to force the thrust center line angle downwardly by pivoting the stator housing 26, the forward and reverse channel member 20, and the intake duct or horn 11 relative to the fixed mounting bracket 31 in a generally vertical plane about the pin 59 through the knuckle 57. Extending from the intake horn or duct 11 for movement therewith is an arm 75 (FIGS. 1 and 4). A boss 76 is formed in the well of the arm 75. Mounted in the boss 76 for movement therewith is a tilt stop 77. Fixed by bolts to the stationary mounting bracket 31 is one end of a tilt stop bracket 78. A series of openings are formed in the tilt stop bracket 78 in which a downward tilt stop pin 80 is selectively received and in which an upwardly tilt stop pin 81 is selectively received. The downward excursion of the tilt action for the intake horn 11 is limited by the stop 77 engaging the removable stop pin 80. The tilt stop bracket 78 is centrally and longitudinally slotted to receive the tilt stop 77.

As the speed of the water vehicle increases (i.e. above 25 MPH), the dynamic pressure acting on the intake horn or duct 11 increases to lift the intake duct or horn 11, the channel member 20 and the stator housing 26 about the pivot pin 59 of the knuckle 57 and thereby raising the thrust center line angle upwardly. The upward excursion of the tilt action for the intake horn 11, the channel member 20 and the stator housing 26 is limited by the stop 77 engaging the removable pin 81. Interconnecting the tilt stop bracket 78 and the intake duct or horn 11 is a tension spring 85. It is the tension spring 85 in combination with the distance between the reaction center line 65 and the thrust center line 40 that controls the tilt adjustment action to select the speed of the water vehicle B, preferably of the planing type hull, that would cause the changeover between the downward thrust line angle and the upward thrust line angle. By proper selection of the location of the stop pins 80 and 81 and the characteristics of the tension spring 85, optimum thrust line angle or tilt action can be attained.

Figure 2:
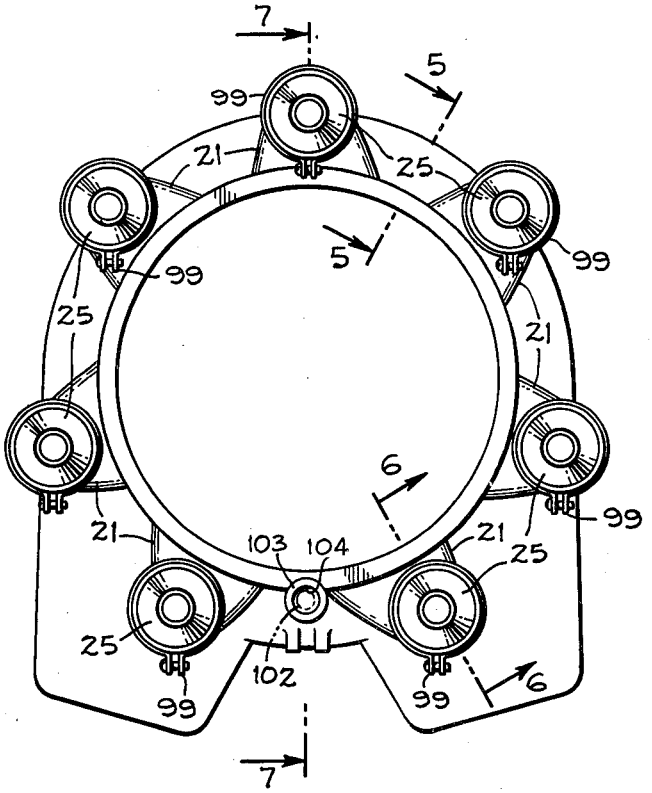
FIG. 2 is a rear elevational view of the forward and reverse channel member embodied in the jet propulsion system shown in FIG. 1, shown with jet propelling discharge nozzles.
Figure 3:
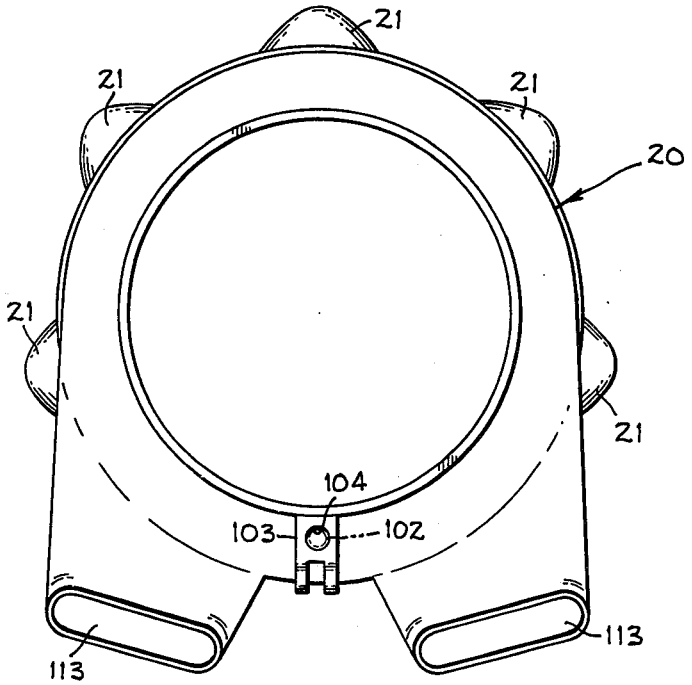
FIG. 3 is a front elevational view of the forward and reverse channel member shown in FIG. 2 illustrated with reverse jet ports.

As shown in FIG. 2, the jet propulsion system 10 employs a plurality of forward discharge nozzles 25 with forward jet ports or orifices having a circular cross-sectional area. The orifices or jet ports of the nozzles 25 are disposed in the same plane and arranged equiangular distances apart and the same radial distances from the thrust center line 40. In this manner, there is a greater tendency to clear or dislodge foreign matter entrained in the water in the vicinity of the intake orifice 12 of the horn 11.

It has been known that large diameter nozzles provide a flow path for a maximum flow rate which optimizes the propulsive efficiency. However, it has also been known that a reduced diameter nozzle tends to minimize cavitation. Cavitation can cause a loss of performance in the lower speed range (i.e. 8–20 MPH). According to the present invention, each nozzle 25, in the preferred embodiment, is made of a suitable resilient material (FIG. 4), such as rubber, and is secured to the conduits 20 of the forward and reverse channel member 20 by suitable clamp 99. With the resilient nozzle 25, the diameter thereof is reduced at the lower speeds (i.e. 8–20 MPH) for the water vehicle B for minimizing cavitation. As the speed of the water vehicle B increases, i.e. above 20 MPH, the pressure at the impeller 15 intake increases. Since the pressure at each of the nozzles 25 is the sum of the impeller pressure head and the impeller intake pressure head, the increased pressure expands the discharge diameter of each of the resilient nozzles 25. As a consequence thereof, the flow rate of the water discharged through the forward jet ports of the nozzles 25 is increased. This action results in greater propulsive efficiency. It is the reaction from the water discharged from the forward jet ports of the nozzles 25 that provide the forward thrust for propelling the water vehicle B in the forward direction. When the water vehicle B reduces its speed to the lower range, the resilient nozzles 25 contract to a reduced discharge diameter. At this time, the velocity of the water discharged from the jet ports of the nozzles 25 is increased, and the thrust at the reduced flow rate is increased at partial power. Additionally, the back pressure on the impeller 15 is increased to increase the input torque requirements. This action causes the engine, shown in part, to deliver the required horsepower at higher torques. Thus, the RPM is reduced, fuel is conserved and wear is reduced.

For reversing the direction of thrust for the water vehicle B, a reverse control arm 100 is actuated by a push-pull cable, not shown. At the distal end of the control arm 100 is one end of a support brakcet 101. The support bracket 101 is fixed to the stator housing 26 and the control arm 100 is pivotally supported by the support bracket 101. Fixed to the support bracket 101 is a guide rail 102. Movable along the guide rail 102 is a bracket 103 with a cylindrical bore 104. The bracket 103 is an integral part of the forward and reverse channel member 20 and assures rectilinear movement thereof in the fore and aft direction relative to the stator housing 26. The intake horn 11 is rigidly connected to the stator housing 26 by means of cap screws 110. By actuating the reverse control arm 100, the reverse channel member is positioned in either one of two positions. Rectilinear movement is imparted to the bracket 103 by the reverse control arm 100 through a linkage including arms 105, link 106 and pins 107, 108 and 109.

In the preferred embodiment, the forward and reverse channel member 20 has an inverted u-shape configuration. Formed in the forward and reverse channel member 20 is a reverse passage 112 which has an inverted u-shape configuration. At the ends of the reverse passage 112 are reverse jet ports 113. In the exemplary embodiment, there are two reverse jet ports 113. When the forward and reverse channel member 20 is shifted forwardly (as shown in FIG. 4), water accelerated by the impeller 15 is conducted through stator passage 111 to the nozzles 25. When the forward and reverse control arm 100 is actuated to move the reverse channel member 20 in the full rearward position along the rail 102, the reverse passage 112 communicates with the water accelerated by the impeller 15 to be discharged through the reverse jet ports 113 (FIGS. 6 and 7).

Adjacent the reverse control arm 100 is a suitable engine exhaust 115 having an engine exhaust port 116. A clean out cover 117 is detachably attached to the intake duct 11.

Although the invention has been shown and described in connection with an outboard/inboard arrangement, it is apparent that the present invention may be employed in connection with either an outboard arrangement or an inboard arrangement.

I claim:

1. A jet propulsion system for mounting on the transom of a water vehicle, comprising:

a. an intake duct;

b. duct support means for supporting said intake duct for movement between an upward tilt angle and downward tilt angle;

c. means connected to said duct support means and defining a reaction center line to urge said duct in a downward tilt angle through a downward propulsive thrust;

d. means connected to said duct support means and defining a thrust center line disposed below the reaction center line to urge said duct in an upward tilt angle through an upward reactive force;

e. a fixed member; and f. a spring interconnecting said intake duct and said fixed member for regulating the tilt angle movement of said intake duct in the changeover between the upward tilt angle and the downward tilt angle.

2. A jet propulsion system as claimed in claim 1 wherein said fixed member is a water vehicle mounting means adapted for mounting the jet propulsion system on the transom of a water vehicle.

3. A jet propulsion system as claimed in claim 2 wherein said duct support means comprises a forward and reverse channel member on which said duct is mounted, said duct being arranged to move with said forward and reverse channel member between the upward tilt angle and the downward tilt angle.

4. A jet propulsion system as claimed in claim 3 wherein said duct support means further comprises a stator housing on which said forward and reverse channel member is supported, said forward and reverse channel member being arranged to move with said stator housing between the upward tilt angle and the downward tilt angle.

5. A jet propulsion system as claimed in claim 4 wherein said means connected to said duct support means and defining a reaction center line includes a steering assembly supported by said water vehicle mounting means, and means carried by said steering assembly and connected to said stator housing for pivotally supporting said stator housing, said forward and reverse channel member and said duct for movement between the upward tilt angle and the downward tilt angle, said last-mentioned means being rotatable by said steering assembly for moving said stator housing, said forward and reverse channel member and said duct in a direction for steering the water vehicle.

6. A jet propulsion system for mounting on the hull of the water vehicle, comprising:

a. support means adapted for mounting on a transom of a water vehicle;

b. a tilt adjustment member fixed to said support means and projecting therefrom, said tilt adjustment member being formed with spaced apart upward limiting and downward limiting stops;

c. an intake duct;

d. duct support means interconnecting said support means and said intake duct for supporting said intake duct for movement to adjustably position said intake duct between an upward tilt angle and a downward tilt angle;

e. an arm carried by said intake duct for movement therewith and disposed in the vicinity of said tilt adjustment member, said arm being formed with a projection extending between said upward limiting stop and said downward limiting stop for limiting the adjusted tilt angle positions of said intake duct;

f. means connected to said duct support means and defining a reaction center line to urge said intake duct in a downward tilt angle through a downward propulsive force; and g. means connected to said duct support means and defining a thrust center line disposed below the reaction center line to urge said intake duct in an upward tilt angle through an upward reactive force.

7. A jet propulsion system as claimed in claim 6 and comprising a spring interconnecting said tilt angle adjustment member and said intake duct in its changeover between the upward movement and the downward movement.

8. A jet propulsion system for a water vehicle comprising:

a. a mounting bracket mounted on the hull of the water vehicle;

b. a steering assembly supported by said bracket, said steering assembly comprising a suitable steering post and knuckle mounted on said post for rotation therewith for a steering movement and for an upward and downward tilt angle movement, said knuckle having an axis which is coincident with a reaction center line of said jet propulsion system, said reaction center line presenting a downward tilt angle propulsive force;

c. a stator housing carried by said knuckle;

d. an impeller in said stator housing having an axis which is coincident with a thrust center line of said jet propulsion system, said thrust center line presenting an upward tilt angle propulsive force, said thrust center line being below said reaction center line, said impeller communicating with said duct for impelling water therethrough;

e. a forward and reverse channel member supported by said stator housing for movement therewith;

f. an intake duct for receiving water supported by said forward and reverse channel member;

g. a tilt adjustment member fixed to said mounting bracket and projecting therefrom, said tilt adjustment member being formed with spaced apart upward-limiting and downward-limiting stops; and h. an arm carried by said intake duct for movement therewith and disposed in the vicinity of said tilt adjustment member, said arm being formed with a projection extending between said upward-limiting stop and said downward-limiting stop for limiting the adjusted tilt angle positions of said intake duct.

9. A jet propulsion system as claimed in claim 8 and comprising a spring interconnecting said tilt adjustment member and said intake duct for regulating the tilt angle adjustment of said intake duct in its changeover between the upward tilt angle movement and downward tilt angle movement.

10. A jet propulsion system as claimed in claim 8 and comprising a rail carried by said stator housing, a bracket fixed to said forward and reverse channel member, said bracket fixed to said forward and reverse channel member being formed with a bore to receive said rail for enabling said forward and reverse channel member and said duct to be moved fore and aft relative to said stator housing, and means connected to said bracket fixed to said forward and reverse channel member for imparting fore and aft movement to said forward and reverse channel members and said duct.

11. A jet propulsion system as claimed in claim 10, said forward and reverse channel member being disposed at one fore and aft position to conduct the flow of water from said intake duct; and comprising a plurality of nozzles communicating with said forward and reverse channel member for discharging water for propelling the water vehicle in a forward direction, said forward and reverse channel member being formed with a reverse passage, and a plurality of reverse ports communicating with said reverse passage, said means connected to said bracket fixed to said forward and reverse channel member being adapted to move said forward and reverse channel member to another position, said reverse passage communicates said intake duct for discharging water from said reverse ports for propelling the water vehicle in a reverse direction.

12. A jet propulsion system as claimed in claim 11 wherein said reverse passage of said forward and reverse channel member has an inverted u-shape configuration for improved control over the flow of water through said reverse ports.

13. A jet propulsion system as claimed in claim 11 wherein said nozzles are disposed at equal angular distances apart in a circular pattern for clearing foreign matter that may be entrained in the water about an intake orifice for said duct.

14. A jet propulsion system for a water vehicle comprising:

a. an intake duct for receiving water;

b. a forward and reverse channel member supporting said intake duct and communicating therewith for conducting the flow of water from said intake duct, said forward and reverse channel member being formed with a reverse passage having the configuration of an inverted u-shape, said forward and reverse channel member being formed with a plurality of reverse ports communicating with said reverse passage, said inverted u-shape configuration of said reverse passage providing improved control over the flow of water through said reverse ports;

c. a stator housing for supporting said forward and reverse channel member;

d. a rail carried by said stator housing;

e. a bracket fixed to said forward and reverse channel member, said bracket being formed with a bore to receive said rail for enabling said forward and reverse channel member and said duct to be moved fore and aft relative to said stator housing;

f. means connected to said bracket for imparting fore and aft movement to said forward and reverse channel member and said duct; and g. a plurality of nozzles supported by said forward and reverse channel member, said forward and reverse channel member being disposed in one position to conduct the flow of water to discharge water from said nozzles for propelling the water vehicle in a forward direction, said forward and reverse channel member being disposed in another position for the flow of water through said reverse passage to discharge water through said reverse ports for propelling said water vehicle in the reverse direction.

* * * * *